US005238312A

United States Patent [19]

Ueki

[11] Patent Number: 5,238,312

[45] Date of Patent: Aug. 24, 1993

[54] IMPACT PRINTER WITH PRINTING PRESSURE SETTING

[75] Inventor: Masaki Ueki, Niigata, Japan

[73] Assignee: NEC Corporation, Tokyo, Japan

[21] Appl. No.: 953,948

[22] Filed: Sep. 30, 1992

[30] Foreign Application Priority Data

Sep. 30, 1991 [JP] Japan ..... 3-250747

[51] Int. Cl.[5] ..... B41J 11/44

[52] U.S. Cl. ..... 400/76; 101/93.03; 395/148

[58] Field of Search ..... 400/76, 61, 166, 124, 400/157.3; 101/93.03; 395/108, 132, 148

[56] References Cited

U.S. PATENT DOCUMENTS

| | | | |
|---|---|---|---|
| 4,683,817 | 8/1987 | Del Signore | 101/93.03 |
| 4,774,882 | 10/1988 | Ohsawa et al. | 101/93.03 |
| 4,810,113 | 3/1989 | Itoh et al. | 101/93.03 |
| 5,039,238 | 8/1991 | Kikuchi et al. | 400/124 |
| 5,048,984 | 9/1991 | Kringe et al. | 400/124 |
| 5,092,692 | 3/1992 | Ueda et al. | 400/157.3 |

*Primary Examiner*—Eugene H. Eickholt
*Attorney, Agent, or Firm*—Foley & Lardner

[57] ABSTRACT

For the line determined by a line feed determining portion 2 to be fed greatly, for the line determined by the line feed determining portion 2 to be fed small and further determined by a printing density determining portion 3 to be printed with a low printing density and, for the line determined by the line feed determining portion 2 to be fed small, determined by the printing density determining portion 3 to be printed with a high density and whose preceding adjacent line is low in printing density, a printing pressure setting portion 4 sets a normal printing pressure. For the line determined by the line feed determining portion 2 to be fed small, determined by the printing density determining portion 3 to be printed with a high printing density and whose preceding adjacent line is high in printing density, the printing pressure setting portion 4 sets a low printing pressure. In consequence, a high density printing cannot be repeated on the same area of the printing form with a high pressure with the result that it can be prevented for wrinkles or breakage to occur on the printing form.

7 Claims, 3 Drawing Sheets

IMPACT PRINTER WITH PRINTING PRESSURE SETTING

FIELD OF THE INVENTION

The present invention relates to an impact printer for printing by applying a pressure to a form and, in particular, to a line printer for printing line by line by feeding each line.

BACKGROUND OF THE INVENTION

In a printer, based on the printing data fed from an upward unit, the line is printed one after another by shifting the print head along the form in a specific direction and, when a specific line has been printed, after the form is shifted in the direction intersecting at a right angle with the specific direction for feeding lines, a next line is printed. When this line feed is made, the traveling distance, that is, amount of the line feed of the form is properly set, and two continuous lines are overprinted so that at least their part is overlapped, or a blank area is left between adjacent lines.

Among such conventional printers, there is one in which a pressure is applied to the form to print to a desired depth of color. Such printers are described in, for example, U.S. Pat. No. 5,048,984.

Incidentally, in this type of printer, when the amount of line feed is made small for overprinting, since the pressure is applied to the same area of the form plural times, if the printing density is especially high, wrinkle or breakage is caused to the form due to this repeatedly applied pressure.

SUMMARY OF THE INVENTION

An object of the present invention is to solve the foregoing problems and to provide a printer which allows the form to be overprinted without causing the wrinkle or breakage to the form.

Another object of the present invention is to provide a printer which allows the printing pressure to be changed per line.

According to the present invention, in order to achieve the foregoing end, there is provided an impact printer comprising a means for determining the amount of the line feed (hereinafter referred to as a line feed determining means) contained within the printing data fed from an upward unit, a means for determining the printing density contained within the printing data (hereinafter referred to as a printing density determining means) and a means for setting the magnitude of the printing pressure (hereinafter referred to as a printing pressure setting means) based on a judgment made by the foregoing line feed determining means, or based on the foregoing judgment and a judgment made by the printing density determining means.

In the present invention, as the foregoing line feed determining means, one can be used which determines whether the line to be printed is at least partially overprinted or not on the preceding adjacent line.

Further, in the present invention, as the foregoing printing density determining means, one can be used which determines whether the printing density at at least part of a line to be printed exceeds a predetermined value or not.

In one embodiment of the present invention, the printing data and the printing pressure data are fed from the printing pressure setting means to a driving portion of a printing mechanism, which comprises a means for changing the printing pressure, and prints each line based on the printing pressure data.

Further, in the printer according to the present invention, for the line determined by the line feed determining means not to be overprinted on the preceding adjacent line and, for the line determined by the line feed determining means to be overprinted on the preceding adjacent line and further determined by the printing density determining means to be printed with a density low enough to cause no wrinkle or breakage on the printing form when overprinted on the preceding adjacent line with a normal pressure, the foregoing printing pressure setting means sets the normal printing pressure; and, for the line determined by the line feed determining means to be overprinted on the preceding adjacent line and further determined by the printing density determining means to be printed with a high printing density possibly causing the wrinkle or breakage to the printing form when overprinted on the preceding adjacent line with the normal pressure, the foregoing printing pressure setting means sets a printing pressure lower than the normal.

Further, the printer according to the present invention may comprises a means for storing the judgment made by the printing density determining means, in which case, for the line determined by the printing density determining means to be printed with the high printing density, (a) when the printing density of the preceding adjacent line, which is stored within the storage means, is low, the printing pressure setting means sets the normal pressure and, (b) when the printing density of the preceding adjacent line, which is stored within the storage means, is high, the printing pressure setting means sets the low printing pressure.

According to the foregoing invention, since a proper printing pressure is set by detecting the line feed or the line feed and printing density when two lines are overprinted from the printing data fed from the upward unit, even if the same area of the form is printed several times with a high density, the sum of the printing pressures does not become too high and, consequently, no wrinkle or breakage is caused.

DESCRIPTION OF THE PREFERRED EMBODIMENTS

Some specific embodiments of the present invention are hereinafter described with reference to the accompanying drawings.

Figure 1:
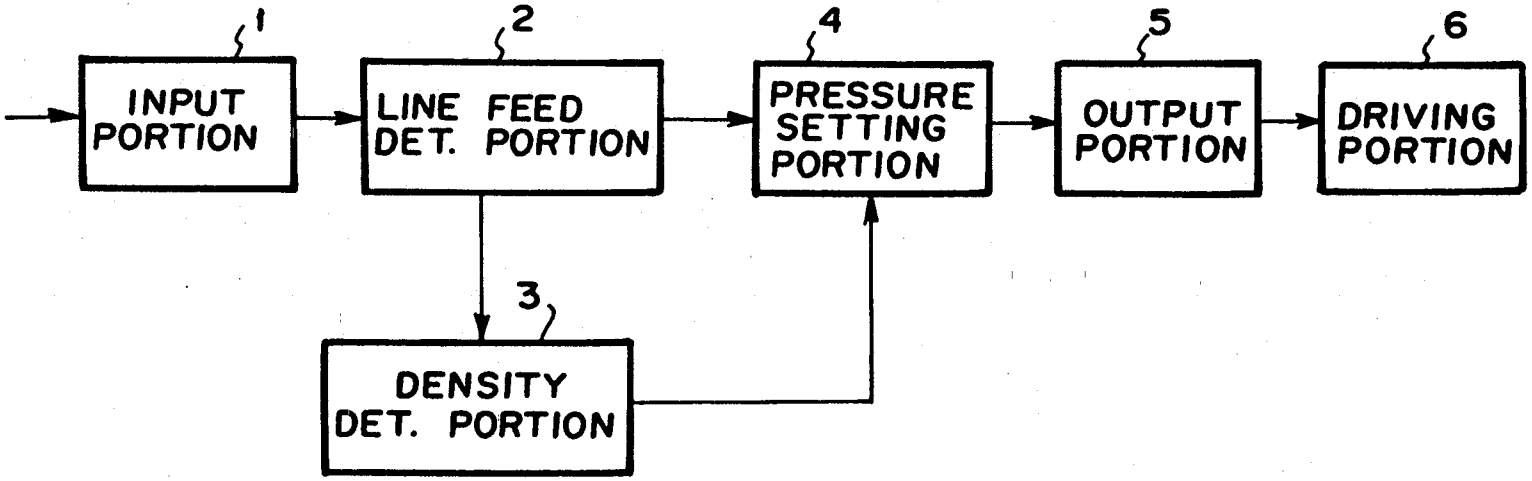
FIG. 1 is a block diagram of the arrangement of a first embodiment of a printer according to the present invention.

FIG. 1 is a block diagram of the essential arrangement of a first embodiment of a printer according to the present invention.

A printing data input portion 1 receives the printing data (including the line feed) fed from an upward unit. A line feed determining portion 2 receives the printing data from the input portion 1 to extract the line feed contained within the data to determine whether the line feed is small enough to allow the line to be overprinted or not. A printing density determining portion 3 receives the printing data from the line feed determining portion 2 to calculate the printing density for each line, which is contained within the data, to determine whether the density exceeds a predetermined value or not. The printing density is calculated as the dot density with, for example, the dot matrix printing system. When it is calculated, its mean over the entire line may be evaluated, or alternatively it may be evaluated for each block obtained by splitting the line into plural portions in the longitudinal direction. If the printing density for at least one of these blocks is high, it may be determined that the printing density of the same line is entirely high. The foregoing predetermined density value can be, for example, 50% with that for a no-clearance printing taken as 100%.

The printing pressure setting portion 4 receives the line feed data or printing density data as well as the printing data from the line feed determining portion 2 or the printing density determining portion 3 to set the normal printing pressure or a lower one. This low printing pressure can be selected from within the range of, for example, 70–80% of the normal printing pressure.

The printing data output portion 5 receives the set printing pressure data as well as the printing data from the printing pressure setting portion 4 to emit as the printing data.

The driving portion 6 of the printing mechanism prints the printing form by applying a pressure to a desired pattern via a sheet of carbon paper and has a means for changing the pressure applied to the printing form for each line.

Figure 2:
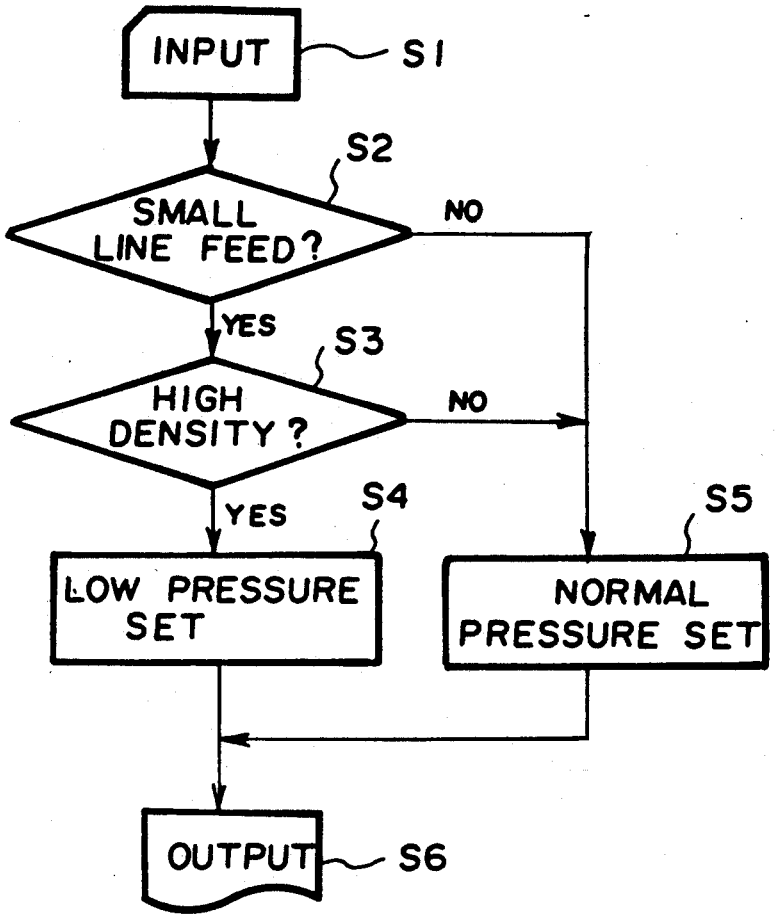
FIG. 2 is a flowchart for explaining the operation of this embodiment.
Figure 3:
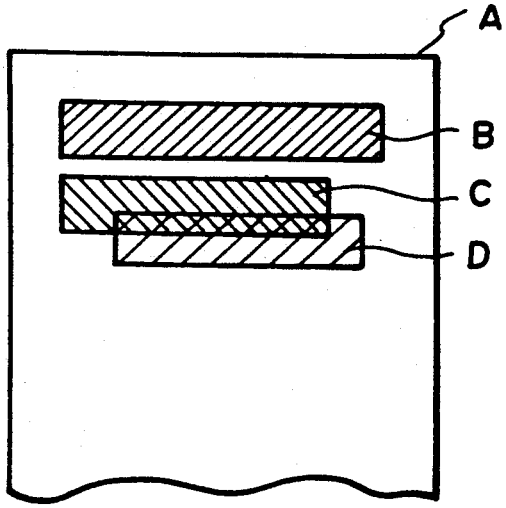
FIG. 3 is a view of an example of the form printed by the printer according to the present invention.

FIG. 2 is a flowchart for explaining the operations of the printing data input portion 1 through the printing data output portion 5. Further, FIG. 3 is a view of an example of the form printed by the printer according to the present invention. The operation of this embodiment is described with reference to these FIGS. 2 and 3 as well as FIG. 1.

As shown in FIG. 3, a first line B is printed on the printing form A, and then a second line C is printed after the line is fed. After the line is further fed, a third line D is printed, and the line feed and the printing are hereafter repeated in the same manner.

If the printing data is entered to the printing data input portion 1 from the upward unit (not shown) (S1), then the data is immediately fed to the line feed determining portion 2, which extracts the line feed from the preceding adjacent line for a line to be printed to determine whether the line feed is small enough to be overprinted on the preceding adjacent line (S2). That is, there are two cases: one in which, as when the line C of FIG. 3 is printed, the line feed from the line B is great enough and, when the line C is printed, it is not overprinted on the line B, and the other in which, as when the line D of FIG. 3 is printed, the line feed from the line C is small and, when the line D is printed, it is overprinted on the line C. Therefore, the line feed determining portion determines which is the case at that time. Incidentally, unless the preceding adjacent line exists, it is determined at S2 that the line feed is great.

If it is determined at S2 that there is no small line feed, then an instruction is sent from the line feed determining portion 2 to the printing pressure setting portion 4 to set the normal pressure for printing together with the printing data on the same line (S5).

By contrast, if it is determined at S2 that there is a small line feed, then the printing data on the same line is sent from the line feed determining portion 2 to the printing density determining portion 3 where the printing density of the line is determined (S3). In the case of the low density, since the wrinkle or breakage is difficult to occur at the overprinted area of the form, an instruction is fed from the printing density determining portion 3 to the printing pressure setting portion 4 to set the normal pressure for printing together with the printing data on the line (S5). Further, in the case of the high density, since there is a chance for the wrinkle or breakage to occur at the overprinted area of the form, an instruction is fed from the printing density determining portion 3 to the printing pressure setting portion 4 to set a lower pressure than the normal for printing together with the printing data on the line (S4).

As described above, the printing pressure data set at the printing pressure setting portion 4 is emitted from the printing data output portion 5 to the driving portion 6 of the printing mechanism, together with the printing data (S6), where the same line is printed according to these data.

Figure 4:
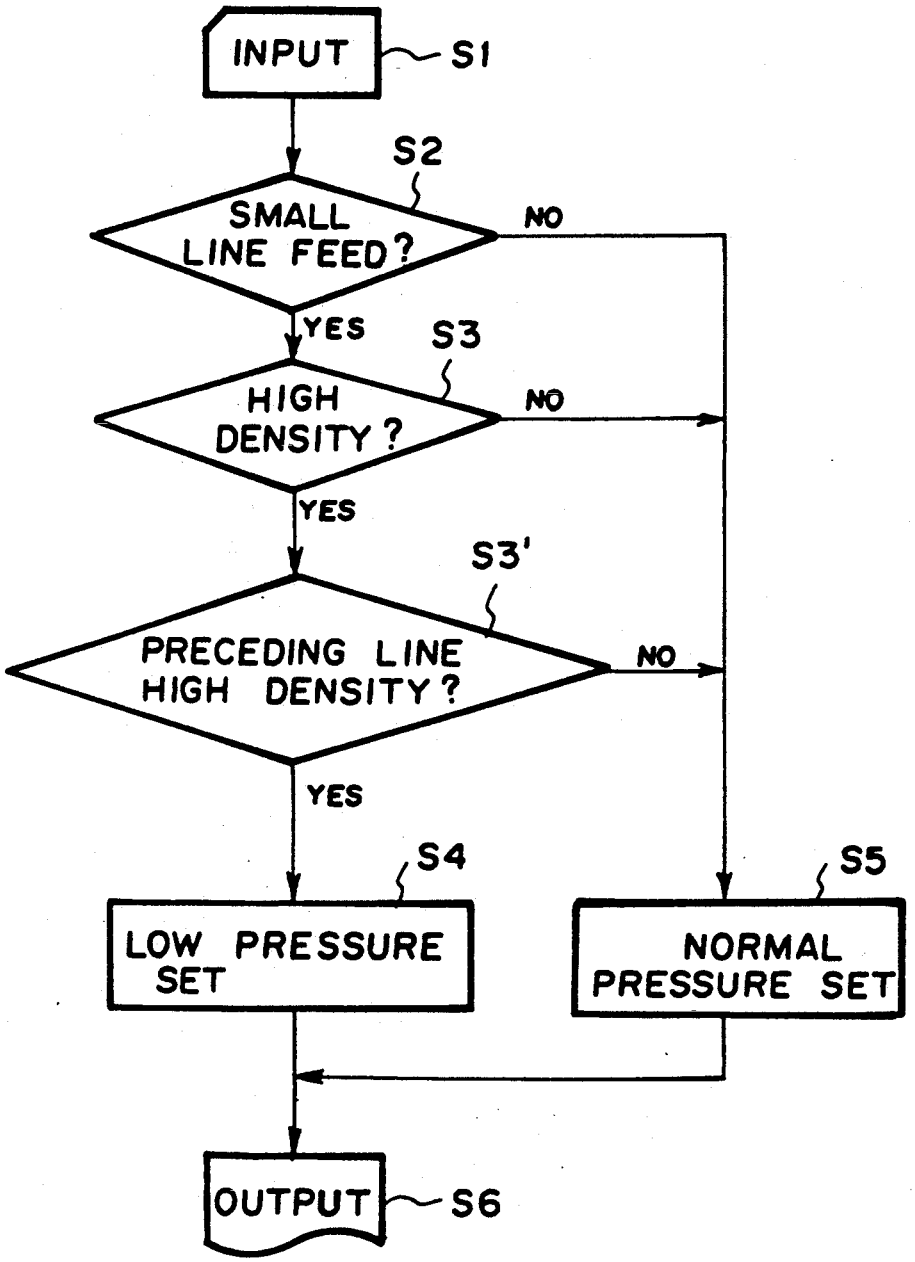
FIG. 4 is a flowchart for explaining the operation of a second embodiment of the printer according to the present invention.

FIG. 4 is a flowchart for explaining the operation of a second embodiment according to the present invention. The arrangement of this embodiment only differs from that of the first embodiment in that the printing density determining portion 3 of FIG. 1 has a means for storing the printing density data. In this embodiment, when the printing density is determined at the printing density determining portion 3, its result is stored.

The operation of this embodiment only differs from that of the first embodiment in that it involves S3', as shown in FIG. 4. That is, if it is determined at S3 that the line to be printed is to be printed with the high density, then the printing density of the preceding adjacent line, which is stored within the printing density determining portion 3, is referred to (S3'). If the preceding adjacent line is printed with the low density, since the wrinkle or breakage is difficult to occur on the form even if the new line is overprinted on the preceding line with the high density, an instruction is sent from the printing density determining portion 3 to the printing pressure setting portion 4 to set the normal pressure for printing together with the printing data on the same line (S5). Further, if the preceding adjacent line is printed with the high density, since, if the new line is overprinted thereon with the high density, the wrinkle or breakage is caused to the form, an instruction is sent from the printing density determining portion 3 to the printing pressure setting portion 4 to set the low pressure for printing together with the printing data on the same line (S4).

According to this second embodiment, when the preceding adjacent line is printed with the low density, since the printing pressure of the line to be printed is not extremely lowered, the depth of printed color cannot be too lowered.

The present invention is not restricted to the foregoing embodiments, but various changes and modifications may be made thereto within the scope and spirit of the claims.

What is claimed is:

1. Impact printer comprising a means for determining the amount of the line feed contained within the printing data fed from an upward unit; a means for determining whether the printing density contained within said printing data is great or small; and a means for setting the high or low printing pressure based on a judgment by said line feed determining means or based on said judgment and a judgment by said printing density determining means.

2. Impact printer as set forth in claim 1 wherein said line feed determining means determines whether the line to be printed is at least partially overprinted on the preceding adjacent line or not.

3. Impact printer as set forth in claim 1 wherein said printing density determining means determines whether the printing density at least at part of the line to be printed exceeds a predetermined value or not.

4. Impact printer as set forth in claim 1 wherein the printing data and the printing pressure data are fed from the printing pressure setting means to a driving portion of the printing mechanism, said driving portion comprising a means for changing the printing pressure to print each line based on said printing pressure data.

5. Impact printer as set forth in claim 1 wherein, for the line determined by said line feed determining means not to be overprinted on the preceding adjacent line and, for the line determined by said line feed determining means to be overprinted on the preceding adjacent line and further determined by said printing density determining means to be printed with a low printing density causing no wrinkle or breakage to the printing form when overprinted on the preceding adjacent line with a normal pressure, said printing pressure setting means sets the normal printing pressure; and, for the line determined by said line feed determining means to be overprinted on the preceding adjacent line and further determined by said printing density determining means to be printed with a high printing density possibly causing the wrinkle or breakage to the printing form when overprinted on the preceding adjacent line with the normal pressure, said printing pressure setting means sets a lower printing pressure than the normal.

6. Impact printer as set forth in claim 1 comprising a means for storing the judgment made by said printing density determining means.

7. Impact printer as set forth in claim 6 wherein, for the line determined by said line feed determining means not to be overprinted on the preceding adjacent line and, for the line determined by said line feed determining means to be overprinted on the preceding adjacent line, further determined by said printing density determining means to be printed with a printing density low enough to cause no wrinkle or breakage to the printing form when overprinted on the preceding adjacent line with the normal pressure and, for the line determined by said line feed determining means to be overprinted on the preceding adjacent line, and further determined by said printing density determining means to be printed with a high printing density possibly causing the wrinkle or breakage to the printing form when overprinted on the preceding adjacent line with the normal pressure and whose preceding adjacent line is low in printing density, which is stored within said storage means, said printing pressure setting means sets a normal printing pressure; and, for the line determined by said line feed determining means to be overprinted on the preceding adjacent line, and further determined by said printing density determining means to be printed with the high printing density and whose preceding adjacent line is high in printing density, which is stored within said storage means, said printing pressure setting means sets a lower printing pressure than the normal.

* * * * *